US009538785B2

(12) United States Patent
Loos et al.

(10) Patent No.: US 9,538,785 B2
(45) Date of Patent: Jan. 10, 2017

(54) CONTAINER FOR SNUS, TOBACCO RELATED OR SMOKING RELATED ARTICLES AND METHOD

(71) Applicant: Imperial Tobacco Limited, Bristol (GB)

(72) Inventors: Marion Loos, Hamburg (DE); Hitesh Bagai, Bristol (GB); Slavomir Novak, Hamburg (DE)

(73) Assignee: Imperial Tobacco Limited (GB)

( * ) Notice: Subject to any disclaimer, the term of this patent is extended or adjusted under 35 U.S.C. 154(b) by 0 days.

(21) Appl. No.: 14/609,513

(22) Filed: Jan. 30, 2015

(65) Prior Publication Data

US 2015/0216230 A1 Aug. 6, 2015

(30) Foreign Application Priority Data

Feb. 5, 2014 (EP) ..... 14154042

(51) Int. Cl.

| | |
|---|---|
| ***A24F 23/00*** | (2006.01) |
| ***A24F 15/12*** | (2006.01) |
| ***B65D 25/04*** | (2006.01) |
| ***B65D 41/04*** | (2006.01) |
| ***B65D 55/02*** | (2006.01) |

(Continued)

(52) U.S. Cl.

CPC ..... *A24F 23/00* (2013.01); *A24F 15/12* (2013.01); *B65D 21/08* (2013.01); *B65D 25/04* (2013.01); *B65D 25/06* (2013.01); *B65D 41/04* (2013.01); *B65D 51/28* (2013.01); *B65D 55/02* (2013.01);

(Continued)

(58) Field of Classification Search

CPC ..... A24F 23/00–23/04; B65D 21/00; B65D 21/08; B65D 21/086; B65D 21/083; B65D 2209/00; B65D 25/04; B65D 25/06; B65D 25/02; B65D 25/005; B65D 41/04; B65D 41/0492; B65D 41/06; B65D 51/28; B65D 51/2807; B65D 51/2857

See application file for complete search history.

(56) References Cited

U.S. PATENT DOCUMENTS 4,793,475 A * 12/1988 Itzel ..... B65D 51/2814 206/219

4,950,094 A * 8/1990 Yorks ..... A45D 40/04 222/390

(Continued)

FOREIGN PATENT DOCUMENTS

WO 9625337 8/1996

OTHER PUBLICATIONS

Extended European Search Report in European Patent Application No. 14154042.7.

*Primary Examiner* — Anthony Stashick
*Assistant Examiner* — Mollie Impink
(74) *Attorney, Agent, or Firm* — Plumsea Law Group, LLC

(57) ABSTRACT

The invention relates to a container for tobacco related or smoking related articles, in particular snus, and a method of manufacturing such a container. The container comprises a base portion and a top portion defining a first compartment between the base portion and the top portion. The base portion or the top portion comprises a displaceable wall and a cover defining a second compartment between the displaceable wall and the cover. The displaceable wall is coupled to the base portion or the top portion by a screw thread for displacing the displaceable wall by rotating the displaceable wall.

9 Claims, 5 Drawing Sheets

(51) Int. Cl.
*B65D 21/08* (2006.01)
*B65D 25/06* (2006.01)
*B65D 51/28* (2006.01)

(52) U.S. Cl.
CPC ..... *B65D 2209/00* (2013.01); *Y10T 29/49881* (2015.01)

(56) References Cited

U.S. PATENT DOCUMENTS

| | | | | |
|---|---|---|---|---|
| 8,074,841 | B1 | 12/2011 | Craig et al. | |
| 2009/0057312 | A1* | 3/2009 | Beyers, III ..... | B65D 51/28 220/254.1 |
| 2009/0057332 | A1 | 3/2009 | Arzola | |

* cited by examiner

CONTAINER FOR SNUS, TOBACCO RELATED OR SMOKING RELATED ARTICLES AND METHOD

FIELD OF THE INVENTION

The invention relates to a container for tobacco related or smoking related articles, in particular snus and a method of manufacturing such a container.

BACKGROUND

EP 2 349 853 discloses a container comprising a base and a lid defining a first compartment for storing unused snus and in which at least the lid or the base includes a reconfigurable wall to enable a user to form or enlarge a second compartment on the other side of said wall to the first compartment for storing used snus, and a cover for closing the second compartment. The wall is at least partially formed from a resilient material and can be positioned in a selectable one of a plurality of stable positions. The wall is movable into one of said positions in response to the application of pressure to the wall and by deforming it beyond a predetermined point. The disadvantage of this container is, however, that it requires that the consumer gets in direct contact with the reconfigurable wall in order to expand or downsize the second compartment. This is generally uncomfortable and, if used snus or the remains of used snus are kept in the second compartment, the consumer's hands are inevitably soiled.

SUMMARY

It is an object of the invention to provide a container for tobacco related or smoking related articles, in particular snus, with a simplified handling and an improved hygienic handling of used and unused articles. Smoking related articles may also include capsules or cartridges for electronic cigarettes.

In an aspect, a container for tobacco related or smoking related articles, in particular snus, is provided. Smoking related articles may also include capsules or cartridges for electronic cigarettes. The container comprises a base portion and a top portion defining a first compartment between the base portion and the top portion. The base portion comprises a bottom wall and a circumferential side wall. The top portion comprises a side wall coupled to the side wall of the base portion. A displaceable wall is coupled to the top portion defines a second compartment between the displaceable wall and the cover. Advantageously, the displaceable wall is coupled to the top portion by a screw thread which is configured to displace the displaceable wall by rotating the displaceable wall. When the displaceable wall is rotated, it moves linearly along a longitudinal axis of the container while the displaceable wall is rotated around this longitudinal axis. This allows displacing the displaceable wall within the container such that the volumes of the first compartment and the second compartment are adjusted relative to each other. The screw thread provides a well determined movement and at the same time already a certain sealing between the first compartment and the second compartment. The container may advantageously have a dimension that allows it to fit into a single hand. The displaceable wall can then be rotated by one or more fingers of the hand holding the container. This provides a very convenient and simple handling.

Generally and in the context of this specification, a screw thread is a substantially helical structure that converts a rotational movement into a linear movement. The screw thread can comprise a ridge wrapped around a cylinder in the form of a helix. The lead of a screw thread is the linear distance the screw travels in one revolution. The screw thread comprises a matched pair of threads, external and internal which are also referred to as male and female. For example, a screw can have male threads, while its matching hole has female threads. This is also referred to as the gender of the screw thread. The helix of the screw thread can twist in two possible directions. This is referred to as the handedness.

In view of the previous paragraph, the screw thread may advantageously comprise a matched pair of screw threads, one screw thread of the pair of screw threads being arranged on a circumferential side wall of the top portion and one screw thread of the pair of screw threads being arranged around the displaceable wall. The matching pair of screw threads provides a certain sealing between the first and second compartment and thereby improves hygiene.

In an advantageous embodiment, the base portion can comprise side walls extending from the bottom wall. The longitudinal axis along which the displaceable wall moves when it is rotated is then perpendicular to the bottom wall of the base portion.

The container is configured such that both compartments can be opened separately from each other. The base portion and the top portion can be configured to be detachably coupled to each other for opening and closing the first compartment. The cover can also be detachably coupled to the top portion. This allows accessing the first compartment and the second compartment.

The first compartment can be configured to accommodate an unused tobacco related or smoking related article, in particular snus. The second compartment can be configured to accommodate a used tobacco related or smoking related article, in particular used snus. In other words, the second compartment can serve as a waste compartment for the articles or remains of the articles previously contained in the first compartment and after they have been consumed. The displaceable wall can then be moved such that the volume of the second compartment is gradually increased while the volume of the first compartment is decreased. In other words, the volume (inner space) of the first compartment is reduced if the volume (inner space) of the second compartment is increased by rotating the displaceable wall in a first direction of rotation and the volume (space) of the first compartment is increased if the volume of the second compartment is reduced by rotating the displaceable wall in a second direction of rotation opposite to the first direction of rotation In an aspect, the displaceable wall has predetermined dimensions and is made out of rigid (stiff) material. In other words, the displaceable wall does not need to be deformed for adjusting the volumes of the first and second compartments which supports hygienic aspects and the handling of the container.

The container can further comprise a first circumferential side wall attached to and extending from the displaceable wall defining an inner receptacle of a predetermined size. This aspect further prevents any used articles from affecting the unused articles thereby improving the hygiene.

The container can advantageously be configured such that the displaceable wall can be rotated by rotating the cover when the cover is attached to the top portion. A coupling mechanism may be provided between the cover and the displaceable wall that engages when the cover is attached to the container. This aspect particularly supports the positive hygienic factors, as the consumer does not need to touch the displaceable wall which may carry used articles or remains of used articles.

In an embodiment, in order to provide a coupling between the cover and the displaceable wall, the container can further comprise a second circumferential side wall which is attached to the cover. The cover can comprise a cover plate and the second circumferential side wall extending from the cover plate. The second circumferential side wall can then be configured to engage with the first circumferential side wall on the displaceable wall in order to rotate the displaceable wall by rotating the cover plate. In other words, the consumer does not need to touch the displaceable wall but can rotate the displaceable indirectly by rotating the cover plate. This further improves the hygienic factors of the container.

The first and second circumferential side walls may have corresponding protrusions in a longitudinal direction, i.e. in the direction in which the displaceable wall moves when it is rotated. This allows the cover to remain in the closed state while the displaceable wall moves away from the cover into the first compartment. When the displaceable wall is rotated in the opposite direction, the longitudinal protrusions allow the displaceable wall to approach the cover as the cover engages with displaceable wall by the protrusions Advantageously, the first and second circumferential side walls of the cover and the one extending from the displaceable wall overlap in an initial state of the second compartment in which the second compartment has minimum volume. They may still overlap (but over a smaller distance) when the second compartment has maximum volume, i.e. when the displaceable wall has maximum distance from the cover plate. This provides an improved sealing of the second compartment, in particular in combination with the longitudinal protrusions arranged on the first and second circumferential side wall.

The container can further comprise a third circumferential side wall attached to and extending from the top portion. The third circumferential side wall may carry one part of the screw thread (male or female).

The container can further comprise a fourth circumferential side wall attached to and extending from the displaceable wall towards the cover. The fourth wall may then carry the other part of the screw thread (female or male) which corresponds to the screw thread provided on the third circumferential side wall. In other words, the screw thread comprises a matched pair of screw threads which are internal and external and male and female, respectively. This means that the screw thread comprises a matched pair of screw threads, one being arranged on the third circumferential side wall of the top portion and the other being arranged around the displaceable wall.

In alternative embodiments, the displaceable wall may be directly coupled to an outer circumferential side wall of the top portion. The screw thread may then be arranged on the inner side of the respective side wall. The displaceable wall may then either have a corresponding circumferential screw thread or at least some protrusions or the like which are appropriate to engage with the screw thread.

The circumferential side walls according to the aspects and embodiments of the invention may advantageously (but not necessarily) have cylindrical shape.

The handedness of the screw thread can advantageously be chosen such that rotating the cover is appropriate for right handed persons. In an embodiment, the second compartment may be enlarged by turning the cover (cover plate) in a clockwise direction. This is a convenient and simple movement for a right handed person holding the container in the right hand. For a left handed person the screw thread can be configured to operate in the opposite direction such that the second compartment is enlarged by turning the cover in a counter-clockwise direction.

The screw thread can further be configured such that it allows at least one complete revolution of the displaceable wall. The angle of rotation should not be too small. This improves the handling.

The screw thread can advantageously be configured such that it prevents linear movement of the displaceable wall when the displaceable wall is not rotated by the consumer. This prevents that the volumes of the first and second compartment are unintentionally changed.

The container may further comprise a latching mechanism that prevents the displaceable wall from being rotated in the second direction of rotation. This aspect provides that the second compartment can only be enlarged but not downsized anymore. This can be advantageous in order to prevent any content of the second compartment from being squeezed which may affect the fresh content in the first compartment.

The latching mechanism advantageously comprises a further circumferential intersected wall that is arranged between the top portion and the base portion.

A hooking mechanism can further be provided at the outer circumferential side wall which extends from the displaceable wall towards the cover. The hooking mechanism provides that the displaceable wall can only be rotated into the first direction of rotation. The latching mechanism prevents the displaceable wall from being rotated into the second direction of rotation which is opposite to the first one. This provides that the second compartment can only be expanded (thereby decreasing the volume of the first compartment) but not be downsized anymore.

The invention also provides a method of manufacturing a container in accordance with the aspects and embodiments of the invention.

BRIEF DESCRIPTION OF DRAWINGS

Further aspects and characteristics of the invention ensue from the following description of the preferred embodiments of the invention with reference to the accompanying drawings, wherein.

DETAILED DESCRIPTION OF EMBODIMENTS

Figure 1:
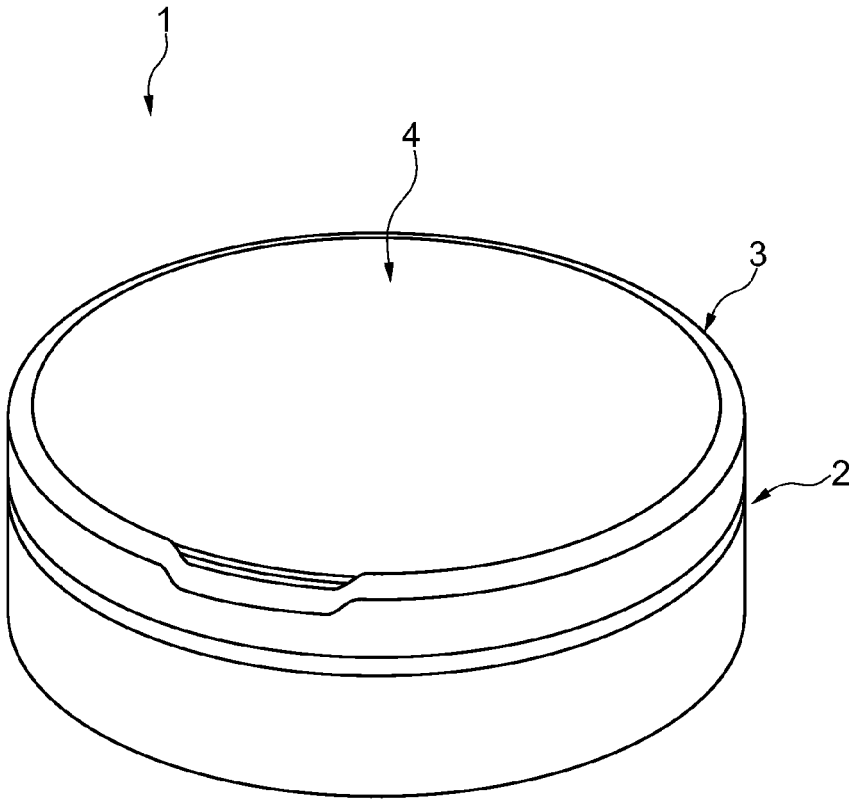
FIG. 1 is a perspective view on a closed container according to an embodiment.

FIG. 1 is a perspective view on a closed container 1 according to an embodiment. The container has a base portion 2 and a top portion (or lid) 3. Attached to the top portion 3 is further a cover 4.

Figure 2:
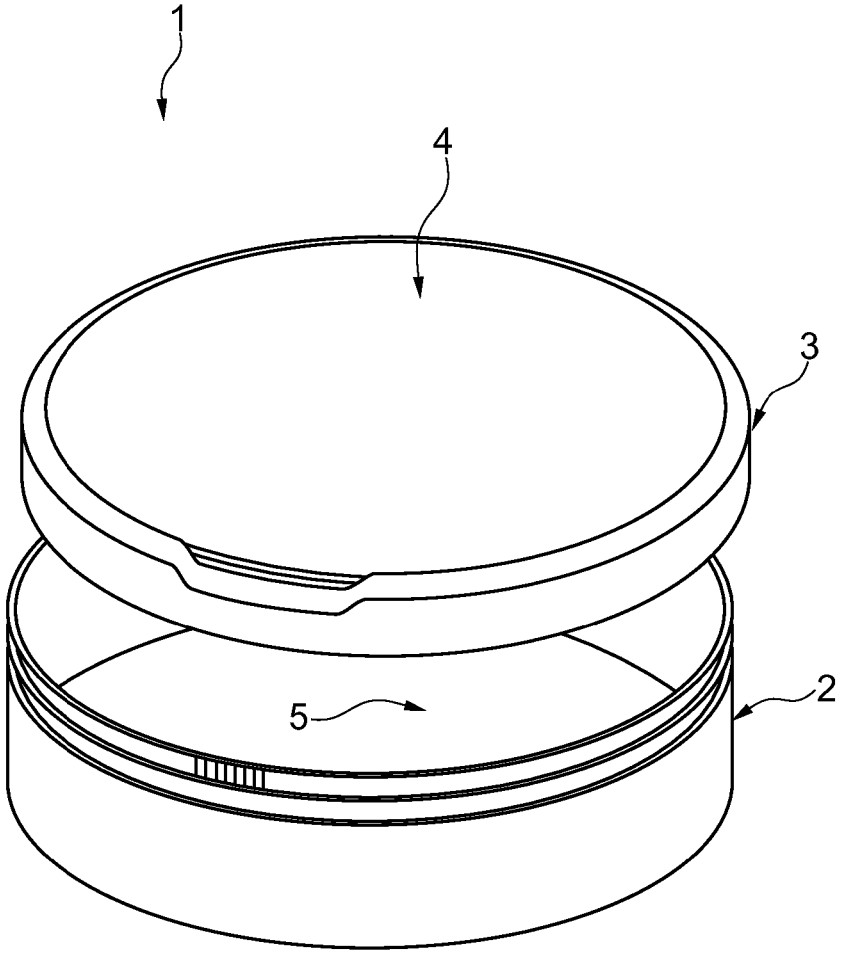
FIG. 2 is a perspective view on the container of FIG. 1 when the first compartment is open.

FIG. 2 is a perspective view on the container 1 of FIG. 1 when the first compartment 5 is open. The first compartment 5 is located between the top portion 3 and the base portion 2.

Figure 3:
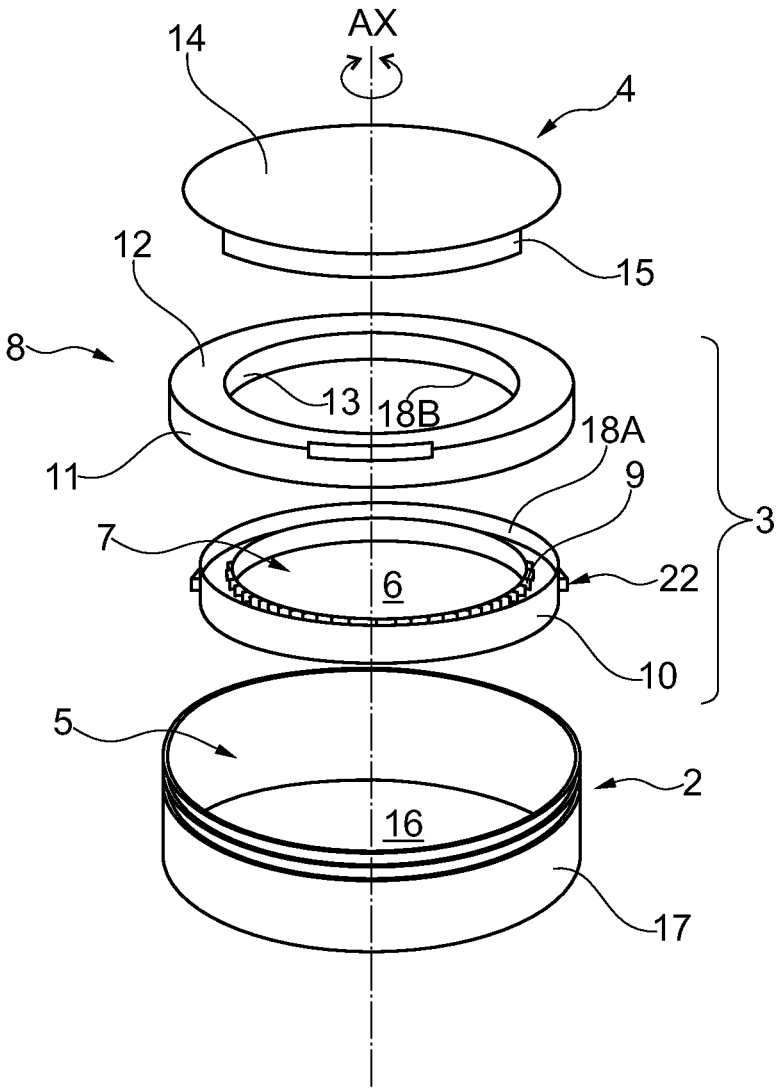
FIG. 3 is a perspective exploded view of the container shown in FIG. 1 and FIG. 2.

FIG. 3 is a perspective exploded view of the container shown in FIG. 1 and FIG. 2. The base portion 2 comprises a bottom wall 16 and a side wall (circumferential) 17. Bottom wall 16 and side wall 17 substantially define the first compartment 5. The first compartment 5 may be used for accommodating fresh (unused) tobacco related or smoking related articles, in particular unused snus (not shown).

The top portion 3 comprises a circumferential fastening element 8 that is configured to engage with the side wall 17 of the base portion 2 and the displaceable wall 6 is coupled to the top portion 3.

A (first) circumferential side wall 9 extends from the displaceable wall 6 towards the cover 4 and delimits a receptacle that forms the basis of the second compartment 7. Any used articles or remains of used articles are held within the area which is delimited by the displaceable wall 6 and the (first) circumferential side wall 9. This prevents to a certain extent that used articles affect the unused articles stored in the first compartment 5.

There is further a cover 4 that can be attached to and detached from the top portion 3. The second compartment 7 is located between the cover 4 and the top portion 3. The bottom plate of the second compartment 7 is formed by the displaceable wall 6. The cover 4 comprises a cover plate 14 and a (second) circumferential side wall 15. The (second) circumferential side wall 15 extends from the cover plate into the container 1, more specifically into the space between the cover plate 14 and the displaceable wall 6.

In this embodiment, the fastening element 8 is basically a ring. It comprises a circular top plate 12 and an outer circumferential side wall 11, as well as an inner circumferential side wall 13 which is further referred to as the third circumferential side wall 13.

A (fourth) circumferential side wall 10 is arranged on the displaceable wall 6. The (fourth) circumferential side wall 10 extends from the displaceable wall 6 towards the cover 4.

The screw thread comprises two corresponding parts 18A and 18B which are arranged on the inner side of the (fourth) circumferential side wall 10 extending from the displaceable wall 6 and the inner side of the (third) circumferential side wall 13 of the fastening element 8 (this part of the screw thread is not visible in this view).

The screw thread 18A, 18B is configured to move the displaceable wall 6 along the longitudinal axis AX by rotating the displaceable wall 6 around the longitudinal axis AX.

The (second) circumferential side wall 15 interacts with the first circumferential side wall 9 attached to and extending from the displaceable wall 6. The first circumferential side wall 9 has vertical protrusions 24 extending in the direction of the longitudinal axis AX (axis of rotation and axis along which the displaceable wall is displaced by rotating it). These protrusions 24 engage with corresponding protrusions (not visible in this view) on the (second) circumferential side wall 15 of the cover 4. This provides an interaction between inner circumferential side wall 13 of the cover 4 and the circumferential side wall 10 on the displaceable wall 6. This means that the displaceable wall 6 can be rotated around the longitudinal axis AX by rotating the cover plate 14 if the cover 4 is in the closed position (as shown, for example in FIG. 1). This means that the consumer does not need to touch the displaceable wall 6 directly in order to increase (or decrease) the volume of the second compartment 7.

Figure 4:
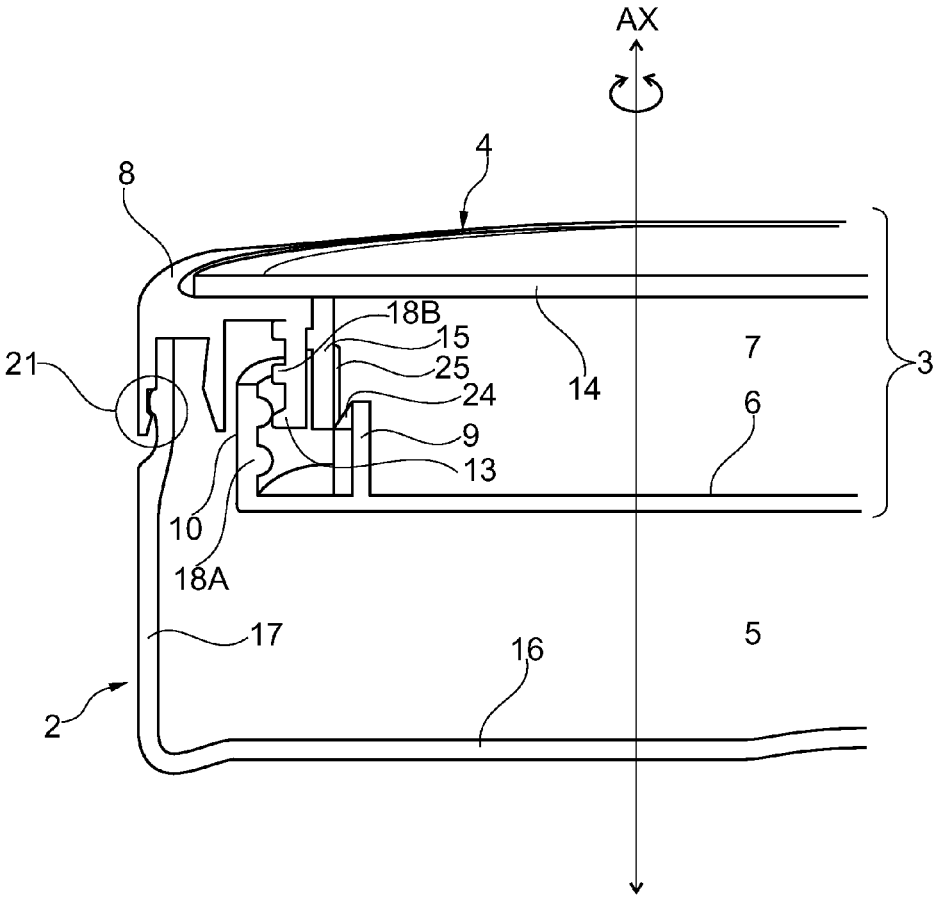
FIG. 4 is a cross-sectional view on a detail of the container shown in FIG. 1 to FIG. 3.

FIG. 4 is a cross-sectional view on a detail of the container shown in FIG. 1 to FIG. 3. The container 1 is in the closed position in which the top portion 3 is attached to the base portion 2 and the cover 4 is attached to the top portion 3. The top portion 3 engages with the base portion 2 (i.e. with the upper rim of the side wall 17 of the base portion 2) by a snap fit 21. This allows opening and closing the first compartment 5 by attaching and detaching the top portion 3.

In the shown state, the second compartment 7 is expanded into the first compartment 5. The displaceable wall 6 has been moved downwardly into the first compartment 5 along the longitudinal axis AX by rotating it around this axis AX. The screw thread comprising corresponding threads 18A and 18B provides that the displaceable wall 6 moves along axis AX when the displaceable wall 6 is rotated around this axis AX. The screw thread 18A is female (internal) and the screw thread 18B is male (external) in this embodiment. The circumferential side wall 15 of the cover 4 has longitudinal protrusions 25 on the inner side that engage with corresponding longitudinal protrusions 24 on the outer side of circumferential side wall 9. This provides that the displaceable wall 6 can be rotated and thereby moved up and down by rotating the cover 4. Furthermore, the longitudinal protrusions 24, 25 and the overlap of circumferential side walls 9 and 15 provide a tight sealing of the second compartment 7.

Figure 5:
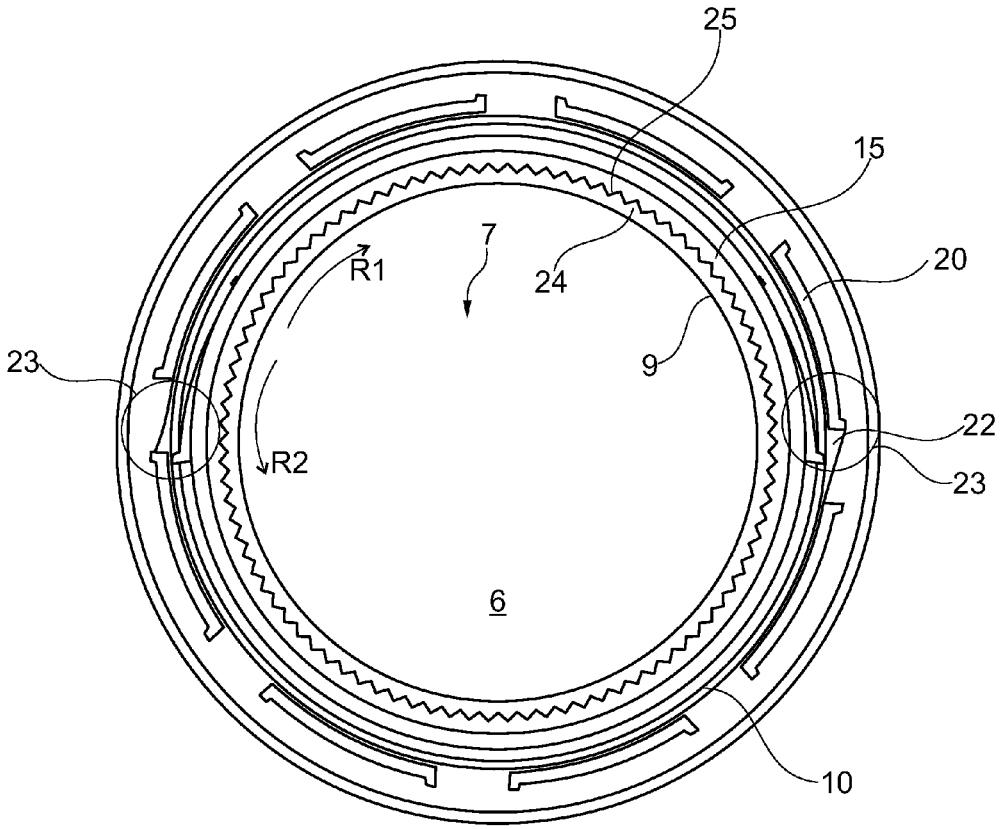
FIG. 5 is a cross-sectional top view of the top portion of the container shown in FIG. 1 to FIG. 3.

FIG. 5 is a cross-sectional top view of the top portion of the container shown in FIG. 1 to FIG. 3. There is the inner circumferential side wall 9 which extends towards the cover from the displaceable wall 6. It engages with the circumferential side wall 15 that extends from the cover by longitudinal circumferential corresponding protrusions 24, 25. There is further a latching mechanism 23 that prevents the displaceable wall 6 from being rotated in one of two possible directions of rotation R1, R2. The latching mechanism 23 comprises a further circumferential intersected wall 20 that is placed between the top portion 3 and the base portion 2. A hooking mechanism 22 is provided at the outer circumferential side wall 10 which extend from the displaceable wall 6 towards the cover 4. In this embodiment, the displaceable wall 6 can only be rotated into the first direction of rotation R1. The latching mechanism 23 prevents the displaceable wall 6 from being rotated into the second direction of rotation R2 which is opposite to the first one R1. This provides that the second compartment 7 can only be expanded (thereby decreasing the volume of the first compartment) but not be downsized anymore.

With respect to the previously described embodiments, it should be noted that the various circumferential side walls have circular cylindrical shape. However, this shape is mainly required for the circumferential side walls carrying the screw threads. Other side walls may have a different shape.

In the above described embodiments, the volume of the first compartment can be about 10 ml to 100 ml, in particular 40 to 80 ml when the displaceable wall is in a first position in which the second compartment has minimum volume. The volume of the second compartment may be between 5 ml and 30 ml, and in particular about 10 ml to 20 ml dependent on the state. In the first state (minimum volume of second compartment and maximum volume of first compartment) the distance between the displaceable wall and the cover plate may be between 4 mm and 8 mm. In the second state (maximum volume of second compartment and minimum volume of first compartment) the distance between the displaceable wall and the cover plate can be between 7 mm and 18 mm.

In the above embodiments, the diameter of the container can be between 50 mm and 100 mm, and in particular 60 mm to 80 mm. The height of the container can be between 20 mm and 30 mm, and in particular 24 mm.

Although the invention has been described hereinabove with reference to specific embodiments, it is not limited to these embodiments and no doubt further alternatives will occur to the skilled person that lie within the scope of the invention as claimed.

LIST OF REFERENCE SIGNS

Container 1
Base portion 2
Top portion 3
Cover 4
First compartment 5
Displaceable wall 6
Second compartment 7
Fastening element 8 (at top portion)
Circumferential top element 12
Bottom wall 16
(Circumferential) side wall of base portion 17
First circumferential side wall 9 (at displaceable wall)
Second circumferential side wall 15 (at cover)
Third circumferential side wall 13 (at top portion)
Fourth circumferential side wall 10 (at displaceable wall)
Screw thread 18
First part (female) of screw thread 18A
Second part (male) of screw thread 18B
Cover plate 19
Circumferential latching elements 20 (at top portion)
Snap fit 21 (between top portion and base portion)
Circumferential engagement elements 22 (at displaceable wall)
Latching mechanism 23
First protrusions 24 (at first circumferential side wall at displaceable wall)
Second protrusions 25 (at second circumferential side wall 15 at cover)

The invention claimed is:

1. A container for tobacco related or smoking related articles, the container comprising a base portion and a top portion defining a first compartment between the base portion and the top portion, the base portion comprising a bottom wall and a circumferential side wall, the top portion comprising a side wall and a cover, wherein the side wall of the top portion is coupled to the circumferential side wall of the base portion, wherein a displaceable wall is coupled to the top portion defining a second compartment between the displaceable wall and the cover, wherein the displaceable wall is coupled to the top portion by a screw thread for displacing the displaceable wall by rotating the displaceable wall, and wherein the cover is coupled to the top portion such that the first compartment and the second compartment can be accessed separately.

2. The container according to claim 1, wherein the screw thread is configured such that the volume of the first compartment is reduced if the volume of the second compartment is increased by rotating the displaceable wall in a first direction of rotation and the volume of the first compartment is increased if the volume of the second compartment is reduced by rotating the displaceable wall in a second direction of rotation opposite to the first direction of rotation.

3. The container according to claim 1, wherein the displaceable wall has predetermined dimensions and is made out of rigid material.

4. The container according to claim 1, being further configured such that the displaceable wall is rotated by rotating the cover when the cover is attached to the top portion.

5. The container according to claim 1, wherein the screw thread comprises a matched pair of screw threads, one screw thread of the pair of screw threads being arranged on a circumferential side wall of the top portion and one screw thread of the pair of screw threads being arranged around the displaceable wall.

6. The container according to claim 1, wherein the screw thread is such that it allows at least one complete revolution of the displaceable wall.

7. The container according to claim 2, further comprising a latching mechanism that prevents the displaceable wall from being rotated in the second direction of rotation.

8. The container according to claim 7, wherein the latching mechanism comprises a further circumferential intersected wall that is arranged between the top portion and the base portion.

9. The container according to claim 8, wherein the latching mechanism comprises a hooking mechanism at an outer circumferential side wall which extends from the displaceable wall towards the cover.

* * * * *